US006804865B2

(12) United States Patent
Grunberger et al.

(10) Patent No.: US 6,804,865 B2
(45) Date of Patent: Oct. 19, 2004

(54) MAGNETIC CLOSURE WITH MUTUAL INTERLOCKING SYSTEM FOR BAGS, RUCKSACKS, ITEMS OF CLOTHING

(75) Inventors: Erico Grunberger, Milan (IT); Franco Revel, Gallarate (IT)

(73) Assignee: SAMA S.p.A., Ronco Briantino (IT)

( * ) Notice: Subject to any disclaimer, the term of this patent is extended or adjusted under 35 U.S.C. 154(b) by 0 days.

(21) Appl. No.: 10/202,017

(22) Filed: Jul. 25, 2002

(65) Prior Publication Data

US 2004/0016089 A1 Jan. 29, 2004

(51) Int. Cl.[7] ..... A44B 21/00
(52) U.S. Cl. ..... 24/303
(58) Field of Search ..... 24/303, 66.1; 248/206.5; 292/251.5; 335/285

(56) References Cited

U.S. PATENT DOCUMENTS 2,615,227 A * 10/1952 Hornik ..... 24/303
3,589,341 A * 6/1971 Krebs ..... 119/865
5,450,658 A * 9/1995 Hicks ..... 24/303
6,101,688 A * 8/2000 Marchesi ..... 24/303
6,301,754 B1 * 10/2001 Grunberger et al. ..... 24/303
6,481,065 B2 * 11/2002 Cogdill ..... 24/303
2003/0019084 A1 * 1/2003 Wong

FOREIGN PATENT DOCUMENTS

EP 923887 A2 * 6/1999 ..... A44B/11/25

* cited by examiner

*Primary Examiner*—James R. Brittain
(74) *Attorney, Agent, or Firm*—Guido Modiano; Albert Josif; Daniel O'Byrne

(57) ABSTRACT

A magnetic closure for bags, rucksacks and items of clothing, comprising a first element and a second element that are suitable to couple to each other, each one of the first and second elements accommodating internally at least one permanent magnet; each one of the first and second elements comprises a base provided with male engagement elements and female engagement elements, the male and female engagement elements of the first element being able to mutually couple respectively to the female and male engagement elements of the second element.

20 Claims, 2 Drawing Sheets

MAGNETIC CLOSURE WITH MUTUAL INTERLOCKING SYSTEM FOR BAGS, RUCKSACKS, ITEMS OF CLOTHING

BACKGROUND OF THE INVENTION

The present invention relates to a magnetic closure with mutual interlocking system for bags, rucksacks, items of clothing and the like.

It is known that snap-acting closures that are already currently commercially available are used for example in bags, rucksacks and the like and utilize, both for closure and for opening, the elasticity of materials that constitute arms of the male element, which enters a corresponding female seat with a snap action.

Other known mechanical solutions provide for spring-actuated operation for the mutual coupling of the two parts.

Magnetic closures are also known which are normally used to close bags and are substantially constituted by magnetic elements that couple to each other by way of their mutual magnetic action. However, these magnetic closure devices have enjoyed relatively limited use, since they do not allow optimum resistance to forces acting at right angles to the direction of the magnetic flux because the two components slide with respect to each other.

U.S. Pat. No. 6,292,985 B1 discloses a magnetic closure that comprises a female element and a male element, each provided respectively with magnetic means, the female element having guiding means for accomodating the male element and engagement means to provide mutual engagement between the female element and the male element so as to contrast the sliding of the male element with respect to the female element.

Such magnetic closure allows to ensure considerable resistance even to forces acting at right angles to the directions of the magnetic flux.

However, such magnetic closure does not allow simple longitudinal, lateral and rotational centering of the male element and of the female element; these elements must be guided with respect to each other so as to achieve correct coupling between the male element and the female element.

Moreover, the male element and the female element must be provided according to two different structures, so that the two elements can be coupled to each other.

This of course entails significant production costs since it is necessary to provide two separate production lines, one for the male element and one for the female element.

SUMMARY OF THE INVENTION

The aim of the present invention is to provide a magnetic closure for bags, rucksacks, items of clothing and the like that allows automatic mutual longitudinal, lateral and rotational centering of the two elements that compose the closure without requiring the user to guide in any way one element of the magnetic closure with respect to the other.

Within this aim, an object of the present invention is to provide a magnetic closure for bags, rucksacks, items of clothing and the like, in which the two elements that compose the magnetic closure are identical.

Another object of the invention is to provide a magnetic closure for bags, rucksacks, items of clothing and the like that is highly reliable, relatively simple to manufacture and at competitive costs.

This aim and these and other objects that will become better apparent hereinafter are achieved by a magnetic closure for bags, rucksacks, items of clothing and the like, comprising a first element and a second element that are suitable to couple to each other, each one of said first and second elements accommodating internally at least one permanent magnet, characterized in that each one of said first and second elements comprises a base provided with male engagement means and female engagement means, said male and female engagement means of said first element being able to mutually couple respectively to the female and male engagement means of said second element.

BRIEF DESCRIPTION OF THE DRAWINGS

Further characteristics and advantages will become better apparent from the following detailed description of a preferred but not exclusive embodiment of the magnetic closure according to the invention, illustrated by way of non-limitative example in the accompanying drawings, wherein.

DESCRIPTION OF THE PREFERRED EMBODIMENTS

Figure 1:
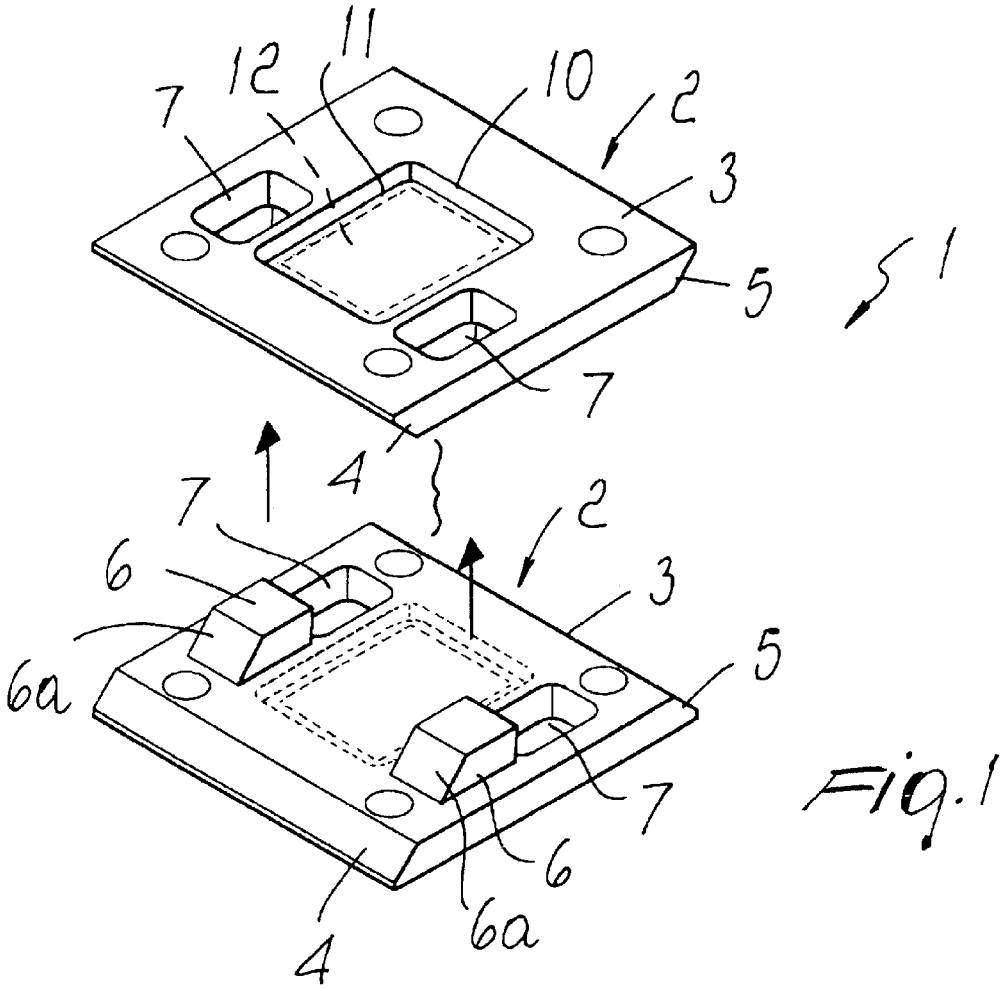
FIG. 1 is an exploded perspective view of the magnetic closure according to the invention.

With reference to the figures, the magnetic closure according to the present invention, generally designated by the reference numeral 1, comprises a first element and a second element 2, which are identical and are therefore designated by the same reference numeral.

For the sake of brevity, reference is made hereinafter to a single element 2, since the characteristics described for such element also apply to the other element designed to couple to it.

Substantially, the element 2 is defined by an element 3 that is shaped for example like a parallelepiped and has two mutually opposite beveled edges 4 and 5 in order to allow easy coupling of the element 2 that is designed to mate with the first element 2 to provide the magnetic closure.

The beveled edges 4 and 5 in fact allow one element 2 to slide with respect to the other element 2, with mutual coupling of the two elements, as described in detail hereinafter.

The parallelepipedal base 3 is provided with male engagement means, which comprise at least one tooth 6, preferably two teeth; in each tooth, the face directed toward the beveled edge 4 of the base 3 has a similar bevel 6*a* that has substantially the same inclination so as to allow the sliding of the opposite element 2, which can therefore slide on the underlying element 2.

The base 3 further comprises female engagement means, which comprise at least one recess 7, preferably two recesses, the number of recesses being equal to the number of teeth 6.

Each recess 7 is arranged adjacent to a corresponding tooth 6 and in alignment with it.

Coupling between the two elements 2 therefore occurs by arranging the two elements so that the teeth 6 face each other and so that the teeth 6 of one element 2 engage in the recesses 7 of the corresponding facing element 2.

In this manner it is possible to provide the two elements 2 in an absolutely identical manner (as regards the engagement means), since the coupling between the two elements is provided by using an element in which the teeth 6 are directed upward and an opposite element in which the teeth 6 are directed downward and therefore the corresponding recesses engage the teeth 6 of the underlying element.

Moreover, each one of the elements 2 is provided with a blind seat 10 which is suitable to accommodate a substantially U-shaped ferromagnetic element 11 that accordingly accommodates internally at least one permanent magnet 12.

The presence of the ferromagnetic element 11 is not strictly necessary and the magnet 12 can be accommodated directly within the element 2.

The insertion of the ferromagnetic element 11 and of the corresponding permanent magnet 12 in the blind seat 10 occurs from the rear of the element 2, i.e., at the face of the element 2 that lies opposite to the face from which the engagement teeth 6 protrude.

Substantially, the provision of two mutually identical elements 2 with beveled edges 4 and 5 inclined for example at approximately 45° with respect to the normal to the upper face and lower face of the element 2, and the use of engagement teeth 6 having likewise beveled faces 6*a* (i.e., substantially having the same inclination as the edges 4 and 5), allow to perform automatic longitudinal, lateral and rotational centering of the two elements 2.

Each one of the two elements 2 is designed to be fixed to a pair of flaps to be joined one another by using the magnetic closure 1 according to the present invention.

Figure 2:
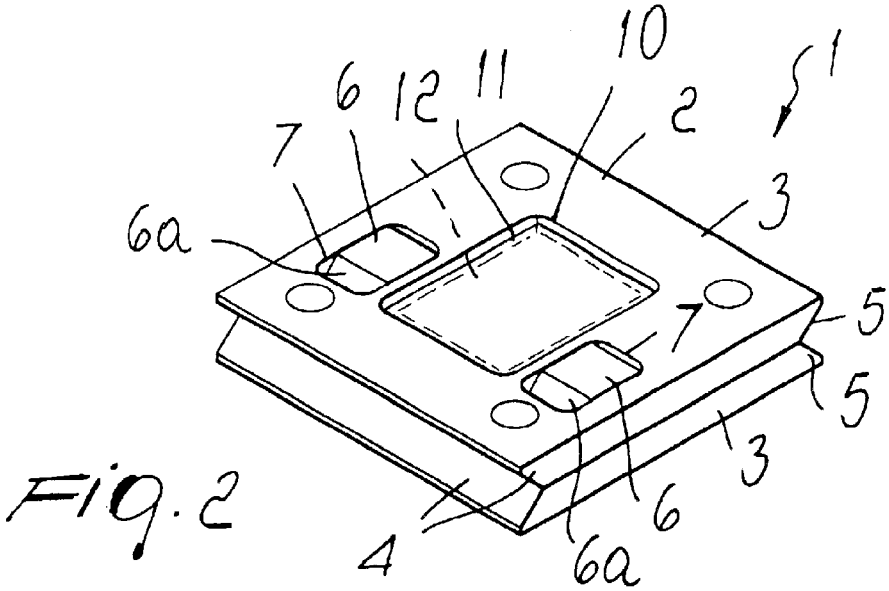
FIG. 2 is a perspective view of the magnetic closure according to the invention in the closed condition.
Figure 3A:
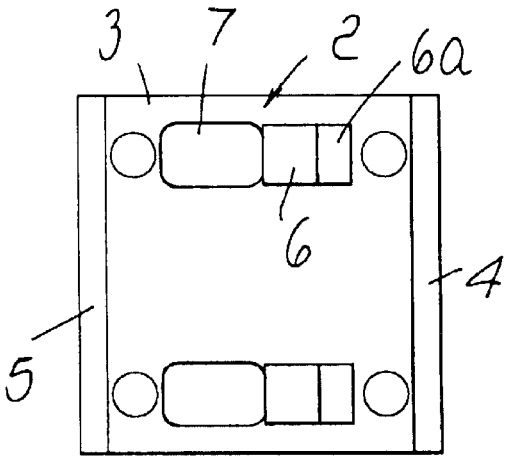
FIG. 3*a* is a top plan view of one of the two identical components of the magnetic closure according to the invention.
Figure 3B:
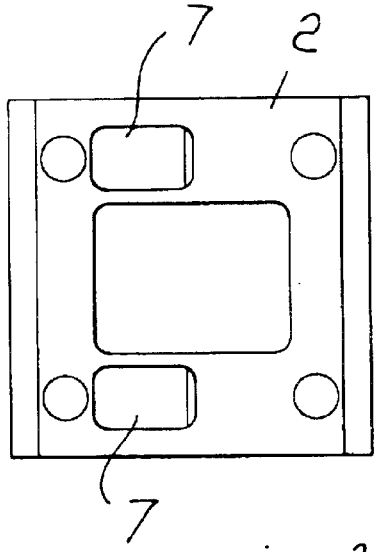
FIG. 3*b* is a bottom plan view of one of the two identical components of the magnetic closure according to the invention.
Figure 4:
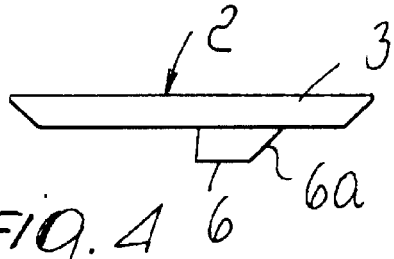
FIG. 4 is a side view of one of the two components of the magnetic closure according to the invention.
Figure 6:
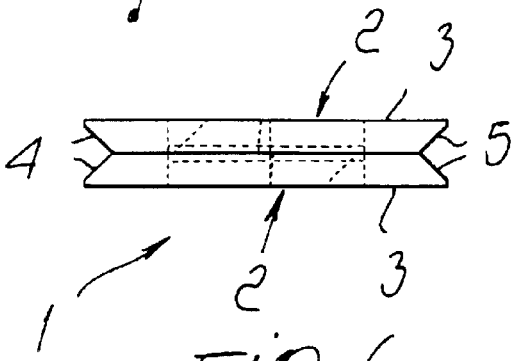
FIG. 6 is a side view of the coupling between the two elements that constitute the magnetic closure according to the invention.
Figure 5:
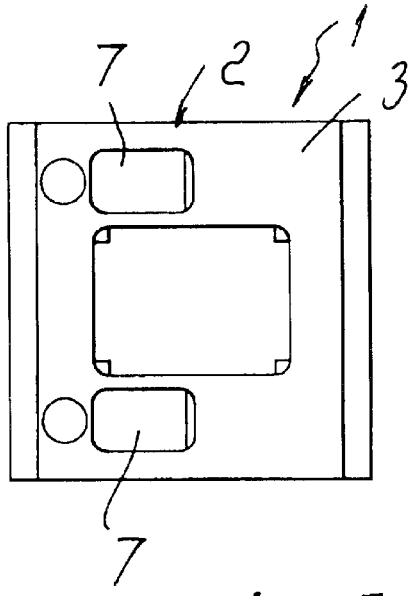
FIG. 5 is a bottom plan view of the magnetic closure according to the invention, with the magnet accommodated therein.

FIG. 2 is a perspective view of the coupling between the two elements 2 and of the engagement of the teeth 6 in the respective through seats 7.

In order to achieve optimum mutual centering of the two elements 2, the center of the magnet 12 accommodated within the ferromagnetic element 11 must preferably lie on the straight line that connects the two right-angled faces of the teeth 6 and likewise connects the two edges of the through seats 7 that are adjacent to the teeth 6.

In practice it has been observed that the magnetic closure according to the invention fully achieves the intended aim and objects, since it allows to achieve closure with automatic longitudinal, lateral and rotational centering of the two elements that compose the magnetic closure, and to provide the two elements in an identical fashion as regards the engagement means (and optionally also as regards their shape).

This entails the advantage not only of having a closure that is simplified from the point of view of the action that can be applied by the user, but also of being able to produce the components of the magnetic closure with a single production line, since the components are mutually identical, as mentioned.

The magnetic closure thus conceived is susceptible of numerous modifications and variations, all of which are within the scope of the appended claims; all the details may further be replaced with other technically equivalent elements.

In practice, the materials used, as well as the contingent shapes and dimensions, may be any according to requirements.

What is claimed is:

1. A magnetic closure for bags, rucksacks and items of clothing, comprising a first element and a second element that are suitable to couple to each other, each one of said first and second elements accommodating internally at least one permanent magnet, wherein each one of said first and second elements comprises a base provided with male engagement means and female engagement means, said male and female engagement means of said first element being able to mutually couple respectively to the female and male engagement means of said second element, wherein said base of each one of said first and second elements has beveled opposite edges that allow the coupling of the first and second elements with mutual sliding thereof.

2. The magnetic closure according to claim 1, wherein said male engagement means comprise two teeth, each tooth having a beveled face at one of the beveled edges of said base, the angle of said beveled face being substantially identical to the angle of said beveled edge of the base.

3. The magnetic closure according to claim 1, wherein said female engagement means comprise two through seats that are aligned with, and adjacent to, said male engagement means.

4. The magnetic closure according to claim 1, wherein said first and second elements are mutually identical.

5. The magnetic closure according to claim 2, wherein said at least one permanent magnet is accommodated in an element made of ferromagnetic material.

6. The magnetic closure according to claim 5, wherein said element made of ferromagnetic material is substantially U-shaped and is accommodated in a blind seat formed in each one of said first and second elements of the magnetic closure.

7. The magnetic closure according to claim 1, wherein the male engagement means of said first element of the magnetic closure engage in said female engagement means of said second element of the magnetic closure and the male engagement means of said second element of the magnetic closure engage in said female engagement means of said first element of the magnetic closure.

8. The magnetic closure according to claim 6, wherein said blind seat is suitable to accommodate said element made of ferromagnetic material and said at least one permanent magnet is open at the face of said base that lies opposite the face from which said male engagement means protrude.

9. The magnetic closure according to claim 1, wherein each one of said first and second elements is designed to be coupled to a respective flap for the closure of a pair of flaps of a bag, rucksack and item of clothing.

10. The magnetic closure according to claim 6, wherein the center of said element made of ferromagnetic material and of said at least one permanent magnet accommodated within said blind seat lies on a straight line that connects faces of said engagement teeth that lie opposite said beveled faces of said engagement teeth.

11. A magnetic closure for bags, rucksacks and items of clothing, comprising a first element and a second element that are suitable to couple to each other, each one of said first and second elements accommodating internally at least one permanent magnet, wherein each one of said first and second elements comprises a base provided with male engagement means and female engagement means, said male and female engagement means of said first element being able to mutually couple respectively to the female and male engagement means of said second element, wherein said female engagement means comprise at least one through seat that is aligned with, and adjacent to, said male engagement means, and wherein said base of each one of said first and second elements has beveled opposite edges that allow the coupling of the first and second elements with mutual sliding thereof.

12. The magnetic closure according to claim 11, wherein that said male engagement means comprise two teeth, each tooth having a beveled face at one of the beveled edges of said base, the angle of said beveled face being substantially identical to the angle of said beveled edge of the base.

13. The magnetic closure according to claim 11, wherein said female engagement means comprise two through seats that are aligned with, end adjacent to, said male engagement means.

14. The magnetic closure according to claim 11, wherein said first and second elements are mutually identical.

15. The magnetic closure according to claim 12, wherein said at least one permanent magnet is accommodated in an element made of ferromagnetic material.

16. The magnetic closure according to claim 15, wherein said element made of ferromagnetic material is substantially U-shaped and is accommodated in a blind seat formed in each one of said first and second elements of the magnetic closure.

17. The magnetic closure according to claim 11, wherein the male engagement means of said first element of the magnetic closure engage in said female engagement means of said second element of the magnetic closure and the male engagement means of said second element of the magnetic closure engage in said female engagement means of said first element of the magnetic closure.

18. The magnetic closure according to claim 16, wherein said blind seat is suitable to accommodate said element made of ferromagnetic material and said at least one permanent magnet is open at the face of said base that lies opposite the face from which said male engagement means protrude.

19. The magnetic closure according to claim 11, wherein each one of said first and second elements is designed to be coupled to a respective flap for the closure of a pair of flaps of a bag, rucksack and item of clothing.

20. The magnetic closure according to claim 16, wherein the center of said element made of ferromagnetic material and of said at least one permanent magnet accommodated within said blind seat lies on a straight line that connects faces of said engagement teeth that lie opposite said beveled faces of said engagement teeth.

* * * * *